United States Patent [19]

Davidson

[11] 4,213,132

[45] Jul. 15, 1980

[54] ANTENNA SYSTEM WITH MULTIPLE FREQUENCY INPUTS

[75] Inventor: Allen R. Davidson, Crystal Lake, Ill.

[73] Assignee: Motorola, Inc., Schaumburg, Ill.

[21] Appl. No.: 926,043

[22] Filed: Jul. 19, 1978

Related U.S. Application Data

[63] Continuation of Ser. No. 797,158, May 16, 1977, abandoned, which is a continuation-in-part of Ser. No. 601,560, Aug. 4, 1975, abandoned.

[51] Int. Cl.[2] ..... H01Q 21/00

[52] U.S. Cl. ..... 343/854; 343/814; 343/858

[58] Field of Search ..... 343/854, 858, 814

[56] References Cited

U.S. PATENT DOCUMENTS

| | | | |
|---|---|---|---|
| 3,202,997 | 8/1965 | Schell | 343/814 |
| 3,255,450 | 7/1966 | Butler | 343/854 |
| 3,295,134 | 12/1966 | Lowe | 343/854 |
| 3,518,695 | 6/1970 | Schroeder | 343/854 |
| 3,714,661 | 1/1973 | Kershaw | 343/858 |
| 3,731,316 | 5/1973 | Sheleg | 343/854 |
| 3,740,756 | 6/1973 | Sosin | 343/858 |
| 3,916,417 | 10/1975 | Wong et al. | 343/854 |

*Primary Examiner*—David K. Moore
*Attorney, Agent, or Firm*—James W. Gillman; Victor Myer; Phillip H. Melamed

[57] ABSTRACT

An improved antenna system is disclosed in which a single antenna array is simultaneously used in conjunction with several independent radio devices. Isolated and independent radio transmitters are coupled, without any signal cancellation, to each and every one of a plurality of isolated independent antenna elements by a combining network which maintains the isolation between each of the radio transmitters and each of the antenna elements. The combining network comprises an array of hybrid networks and creates a predetermined electrical phase difference between each signal received by an individual antenna element. The antenna elements form a single antenna array consisting of circularly disposed corner reflector antennas. Each reflector independently creates an individual radiation pattern and these patterns combine to form a single desired composite radiation pattern. By maintaining isolation between each of a number of radio transmitters, a plurality of these transmitters may be used simultaneously in conjunction with a single antenna array.

44 Claims, 12 Drawing Figures

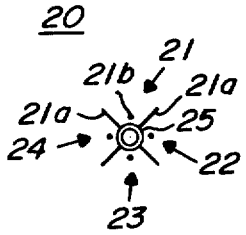
Fig. 1
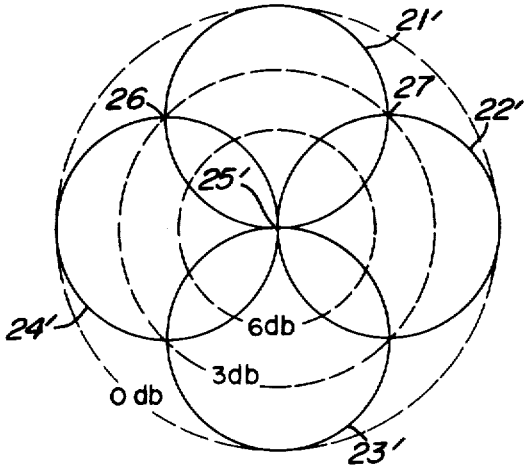
Fig. 2
Fig. 3
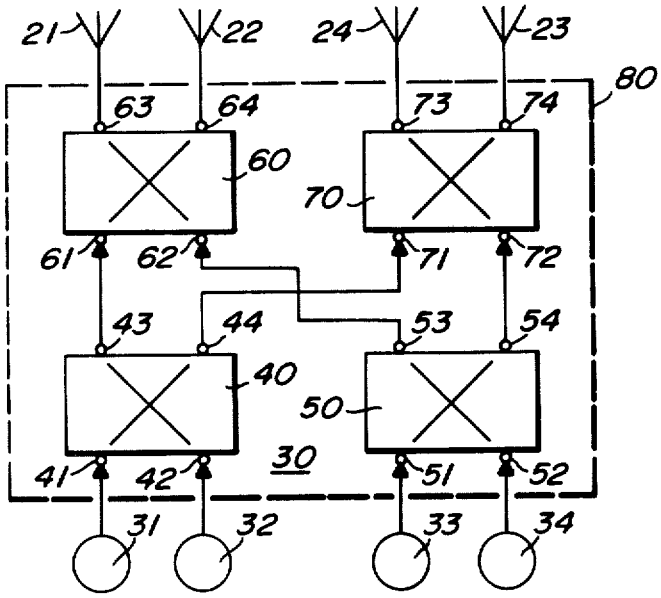
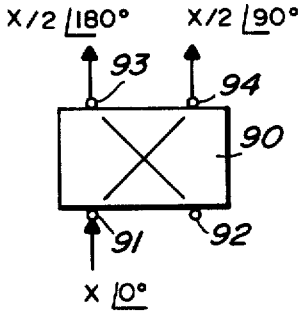
Fig. 4
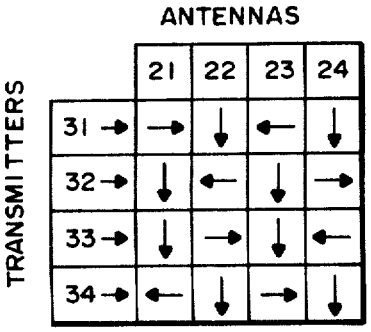
Fig. 5
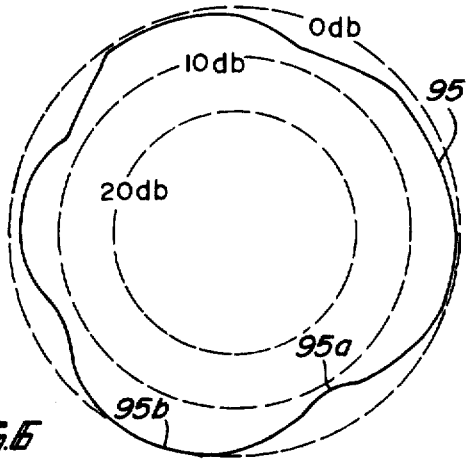
Fig. 6

ANTENNA SYSTEM WITH MULTIPLE FREQUENCY INPUTS

CROSS REFERENCE TO RELATED APPLICATIONS

This is a continuation, of application Ser. No. 797,158, filed May 16, 1977 now abandoned. The continuation in part application 797,158 was based on copending application Ser. No. 601560, filed Aug. 4, 1975, entitled, "Improved Multiple Input Antenna System", having the same inventor and assignee, and now abandoned.

BACKGROUND OF THE INVENTION

The invention relates generally to the field of multiple input antenna systems and more particularly to the simultaneous use of an antenna array by a plurality of independent and isolated radio devices.

There have been a number of different solutions to the basic problem of simultaneously using a single antenna structure in conjunction with a plurality of independent transmitters while maintaining isolation therebetween.

One prior solution uses a single omnidirectional antenna and couples each of the transmitters to this antenna through an associated resonant cavity. Thus an omnidirectional radiation pattern is obtained for each transmitter and the output of each transmitter will not affect the output of any other transmitter. The primary disadvantage of this system is that it requires a separate tuned resonant cavity for each transmitter. Since every transmitter must operate at a substantially different frequency in order for the resonant cavities to provide the required isolation, close channel spacing in such a system is impractical. Also, because of the requirement for a tuned resonant cavity, such a system had an inherently narrow bandwidth. In addition, the resonant cavity must be adjusted whenever the operating center frequency of a transmitter is changed.

Another solution to the problem uses an array of hybrid networks to produce a single output signal which is then used to excite a single omnidirectional antenna element. Each of these hybrid networks combines two input signals to produce a half power output signal at one port while dissipating the rest of the power in a 50 ohm "dummy" load. In a typical eight transmitter network built according to this prior technique, a 9 db loss in power is encountered. The use of hybrid networks does, however, provide isolation between the independent transmitters as well as permitting a wide bandwidth of operation for the antenna system.

Still another solution to the problem is to couple individual omnidirectional antenna elements to each of the transmitters. This solution is not practical because of the large separation that would have to exist between each of the radiating elements in order to provide sufficient isolation between each of the transmitters. Therefore the resultant antenna system would require an extremely large amount of space, especially if a large number of independent transmitters were desired.

In still another solution to the problem, two transmitters are combined by a single hybrid network and the two output signals from this network are then used to excite the two independent antenna elements in a turnstile antenna. This technique provides isolation in addition to a wide bandwidth of operation, but cannot be readily extended to more than two transmitters without using narrow band tuned elements or sacrificing a substantial amount of transmitter output power.

SUMMARY OF THE INVENTION

An object of the present invention is to provide an improved multiple input antenna system for overcoming all of the aforementioned deficiencies..

A more particular object of the invention is to provide an improved multiple input antenna system for at least three independent radio devices in which a single antenna array is simultaneously used by all of the radio devices while broadband isolation between these devices is provided with no substantial power loss.

In one embodiment of the present invention an improved multiple input antenna system is provided, comprising: a plurality of at least three independent, isolated, electrical devices each adaptable for processing radio frequency signals at different radio frequencies; a plurality of isolated antenna elements equal in number to at least the number of said electrical devices, each of said elements disposed in a predetermined manner for generating an associated independent radiation pattern; and a substantially lossless combining network consisting of broadband components having bandwidths including all of said radio frequencies, the network coupled to each of the antenna elements and each of the electrical devices for simultaneously coupling each of the devices to each and every one of the antenna elements while maintaining broadband isolation between all of the antenna elements and all of the electrical devices; the combining network also creating a predetermined phase difference between each of the radiation patterns produced by the antenna elements such that these patterns combine to form a desired composite radiation pattern.

The combining network comprises an array of hybrid networks in which the signals present at each output port of each hybrid network are used to create the desired results without any signal cancellations. Thus isolation between individual electrical devices is maintained over a broad bandwidth and no substantial loss in power is created by the inventive antenna system.

When used as a multiple transmitter antenna system, the present invention provides an easily expandable antenna network for simultaneously radiating several independent radio signals over a single broadband antenna system without incurring a substantial loss in the radiated output signal. Basically, a plurality of at least three transmitters, each supplying an input signal at a different carrier frequency, is connected to a combining network comprising an array of hybrid networks. The combining network maintains isolation between the transmitters and produces a number of isolated output signals equal in number to at least the number of electrical transmitters. Each one of the output signals is proportional to each and every one of the input signals, and each output signal has a predetermined phase. An associated antenna element receives each output signal and radiates it in a directive substantially independent radiation pattern which is directed away from all other antenna elements. Because of the phase of each one of the output signals and the positioning of each one of the antenna elements, all of the independent directive radiation patterns combine to form a desired composite radiation pattern for each of the different frequency transmitters.

BRIEF DESCRIPTION OF THE DRAWINGS

For a more complete understanding of the invention reference should be made to the drawings, in which:

FIG. 1 is a horizontal cross sectional diagram of a four element vertical antenna array;

FIG. 2 is a graph illustrating the horizontal radiation pattern created by each of the antenna elements in FIG. 1;

FIG. 3 is a schematic diagram of a four input antenna system which uses the antenna elements shown in FIG. 1;

FIG. 4 is a diagram illustrating the electrical characteristics of a hybrid network;

FIG. 5 is a table illustrating various signal phase relationships in the antenna system shown in FIG. 3;

FIG. 6 is a graph illustrating a composite horizontal radiation pattern produced by the antenna system in FIG. 3;

DESCRIPTION OF THE PREFERRED EMBODIMENTS OF THE INVENTION

Figure 9:
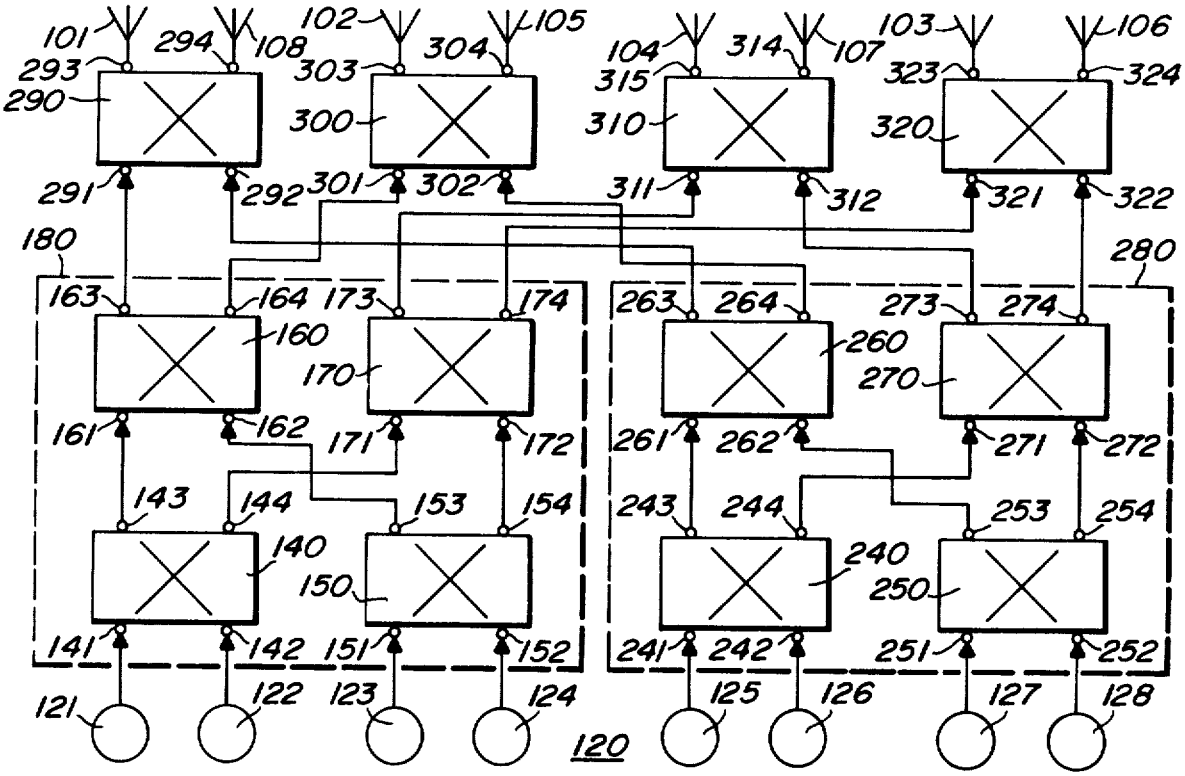
FIG. 9 is a schematic diagram of an eight input antenna system which uses the antenna elements shown in FIG. 7.

FIG. 1 illustrates an antenna array 20 for use at 900 MHz which comprises four corner reflector antenna elements generally indicated at 21, 22, 23 and 24. The corner reflectors are circularly disposed around a center axis 25, and each has a 90° firing aperture which faces radially outwardly. Corner reflector antennas are well known in the state of the art and basically consist of two sides of a bent reflector panel (such as $21_a$) and a center radiating rod (such as $21_b$). In the present embodiment of the invention, center axis 25 is a four inch diameter pipe. The outer diamter of array 20 is 1.25 feet and therefore each reflector antenna has a firing aperture of approximately one foot. Typically the reflector panels are a grid of wires rather than a solid sheet of metal.

FIG. 2 illustrates the theoretical radiation patterns produced by each of the antenna elements illustrated in FIG. 1. The corresponding radiation patterns have been designated by prime notation. Each pattern consists, substantially, of a single main unidirectional lobe radially directed outward from a center point 25' which corresponds to center axis 25 in FIG. 1. Each pattern generated by an antenna element is directed substantially away from all other antenna elements. In this manner, the signal radiated by each antenna element will not be received by other antenna elements and the array 20 can be compactly built since antennas can be placed close together.

FIG. 2 has a nonlinear radial db scale. Each of the individual radiation patterns is illustrated as having 3 db down points, such as points 26 and 27 for pattern 21', which form substantially a 90° angle with the center point 25'. Thus each radiation pattern is said to have a half power beam width of 90°. The 3 db points of the adjacent radiation patterns are substantially coincident. It should be emphasized that FIG. 2 merely depicts the individual radiation patterns that are created by each of the four antenna elements acting individually and not the composite radiation pattern created by the simultaneous excitation of all four of the antenna elements.

FIG. 3 shows a four input transmitter antenna system 30 which uses the antenna elements 21 through 24 depicted in FIG. 1 and identically numbered. Independent and isolated RF (radio frequency) generators 31, 32, 33, and 34, each operative at a different carrier frequency, are shown connected to the first and second input ports (41 and 42) of hybrid network 40 and the first and second input ports (51 and 52) of hybrid network 50, respectively. The first, second, third and fourth ports of a typical hybrid network, such as network 40, are designated as 41, 42, 43, and 44 respectively. Similar notation for the network ports will be used for all subsequently referred to hybrid networks. The antenna system 30 also comprises a hybrid network 60 having its third and fourth ports (63 and 64) coupled to antenna elements 21 and 22 respectively, and a hybrid network 70 having its third and fourth ports (73 and 75) coupled to antenna elements 24 and 23, respectively. Input ports 61 and 62 of hybrid network 60 are connected to ports 43 and 53, respectively, and input ports 71 and 72 of hybrid network 70 are connected to ports 44 and 54, respectively. The hybrid networks 40, 50, 60 and 70 form a combining network 80, shown dashed. Thus the antenna system 30 basically comprises a plurality of transmitters 31–34, a plurality of antenna elements 20;14 24, and a combining network 80.

FIG. 4 illustrates the electrical properties of a typical hybrid network 90 having terminals 91, 92, 93 and 94. An input signal X having a phase angle of 0° is shown present at terminal 91 and results in output signals being created at terminals 93 and 94, each having half the magnitude of the input signal at terminal 91. The signal at terminal 93 is 180° out of phase with the signal at terminal 91 and the signal at terminal 94 is 90° out of phase with the signal at terminal 91. The signal present at terminal 91 creates no signal at terminal 92 and therefore this terminal is referred to as the "isolated terminal". When separate independent signals at different frequencies are applied to both terminals 91 and 92, broadband isolation is maintained between these signals and an addition of composite signals is obtained at terminals 93 and 94 which are also isolated from each other. Hybrid networks, such as the one shown in FIG. 4 are commonly available and are well known in the art as 90° hybrid couplers. There also exist 180° hybrid networks in which the phases of the signals at terminals 93 and 94 differ by 180° from each other. These 180° hybrid networks also maintain broadband isolation between each of the input ports and each of the output ports.

FIG. 5 is a table which illustrates the phase relationships in FIG. 3 of each signal received by each antenna element from each transmitter when all of the hybrid networks are 90° couplers. In this table a vector pointing in a right hand direction is considered to have a phase of 0°, a vector pointing in an upward direction has a phase of 90°, a vector pointing in a left hand direction has a phase of 180°, and a vector pointing in a downward direction has a phase of 270°. Hence each signal radiated by an antenna element is 90° out of phase with the signals radiated by the adjacent antenna elements.

For example, the signals radiated by antenna element 21 will be 90° out of phase with the signals radiated by antenna elements 22 and 24. The signal actually radiated by a typical antenna element, such as element 21 for example, would be a composite signal comprising one fourth the magnitude of the signal produced by generator 31 at a phase angle of 0°, one fourth of the signal of generator 32 at an angle of 270°, one fourth of the signal of generator 33 at an angle of 270°, and one fourth the signal of generator 34 at an angle of 180°.

FIG. 6 illustrates an actual composite radiation pattern 95 created by the circuit 30, shown in FIG. 3, which the antenna elements 21 through 24 are arranged as indicated in FIG. 1. FIG. 6 is plotted on a linear radial db scale. The composite pattern 95 is roughly omnidirectional with the largest null (95A) being approximately 8 db down from the peak value (95B) of the pattern. The composite pattern is generally omnidirectional since each of the individually created patterns is 90° out pf phase from each of the adjacent patterns and each pattern has its 3 db points substantially coincident with the 3 db points of the adjacent patterns. Signals from each of the transmitters 31 through 34 will radiate in a pattern similar to that shown in FIG. 6 and all four of the transmitters can simultaneously radiate signals from the same antenna elements 21-24 while isolation is maintained between all the transmitters 31-34 and all the antenna elements 21-24. Therefore a single antenna network has been provided for simultaneously radiating a number of independently generated RF signals over the same antenna array.

A significant aspect of the invention is the combining of four independent sources on a single compact antenna structure without the creation of deep nulls on the composite radiation pattern and while maintaining broadband isolation between all of the independent sources. This is accomplished by the use of a substantially lossless broadband combining network 80 in combination with a plurality of antenna elements, each of which independently generates a directive radiation pattern directed away from all other antenna elements. A desired composite radiation pattern is then produced by the combination of these independent directive radiation patterns and by the network 80 providing a desired 90° phase shift between each of these patterns. The antenna system 30 can be easily expanded to accomodate any number of additional different frequency generators, as will be explained subsequently. In addition, any of the transmitters 31 through 34 can be removed without impairing the system operation.

While the positioning of the antenna array 20 shown in FIG. 1 resulted in the radiation pattern shown in FIG. 6. variations in this pattern can be obtained by skewing the orientation of the antenna elements 21 through 24. This skewing technique is well known in the prior art and has been successfully used to create a better omnidirectional pattern when nulls have created problems on a composite radiation pattern.

Figure 7:
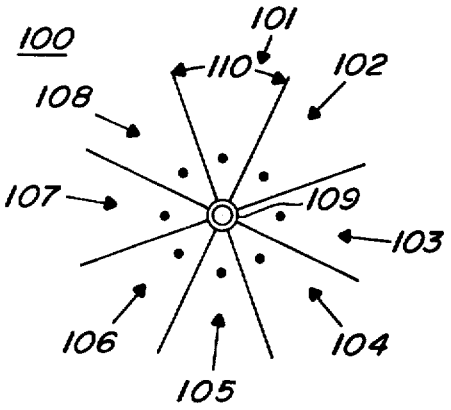
FIG. 7 is a horizontal cross sectional diagram of an eight element vertical antenna array.

FIG. 7 shows another embodiment of the present invention in which an antenna array 100 for use at 900 MHz is illustrated as comprising eight corner reflector antenna elements, generally indicated by 101 through 108, which are circularly disposed about a center axis 109. The overall diameter of array 100 is 4.5 feet and center axis 109 actually consists of a 4 inch pipe which is used to support the reflector panels of each of the corner reflector antennas. Each of the reflector antennas has a 45° firing aperture.

Figure 8:
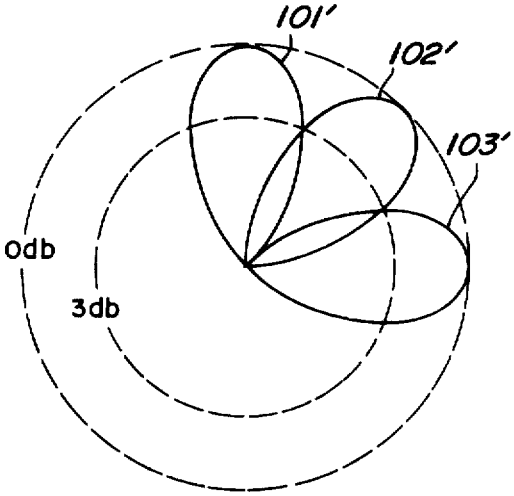
FIG. 8 is a graph illustrating the horizontal radiation patterns of several of the antenna elements in FIG. 7.

In FIG. 8 (having the same scale as FIG. 2) a plurality of theoretical horizontal radiation patterns corresponding to several of the reflector antennas shown in FIG. 7 is illustrated with corresponding patterns being designated by prime notation. Each of the radiation patterns is shown as having a 45° 3 db beam width. This is the reason for the much larger overall diameter of array 100 as compared to array 20, since a larger firing aperture dimension, generally indicated by reference number 110 in FIG. 7, is required to produce a 45° beam width radiation pattern.

FIG. 9 illustrates an eight transmitter antenna system 120, similar to the antenna system 30, which uses the antenna array depicted in FIG. 7. Four hybrid networks 140, 150, 160 and 170 are interconnected and form a network 180 that is identical to the network 80 illustrated in FIG. 3. Four transmitters 121, 122, 123, and 124 are connected to network 180 and correspond to transmitter 31, 32, 33, and 34, respectively. Similarly, four hybrid networks 240, 250, 260, and 270 form a circuit 280 which is identical to circuit 180, and four transmitters 125, 126, 127, and 128 are connected to network 280 and correspond to transmitters 121-124, respectively. Four additional hybrid networks 290, 300, 310, and 320 couple networks 180 and 280 to antenna elements 101 through 108. Input ports 291 and 292 are coupled to ports 163 and 263, respectively, and output ports 293 and 294 are coupled to antenna elements 101 and 108, respectively. Input ports 301 and 302 are coupled to ports 164 and 264, respectively, and output ports 303 and 304 are coupled to antenna elements 102 and 105, respectively. Input ports 311 and 312 are coupled to ports 173 and 272, respectively, and output ports 313 and 314 are coupled to antenna elements 104 and 107, respectively. Input ports 321 and 322 are coupled to ports 174 and 274, respectively, and output ports 323 and 324 are coupled to antenna elements 103 and 106, respectively.

Figure 10:
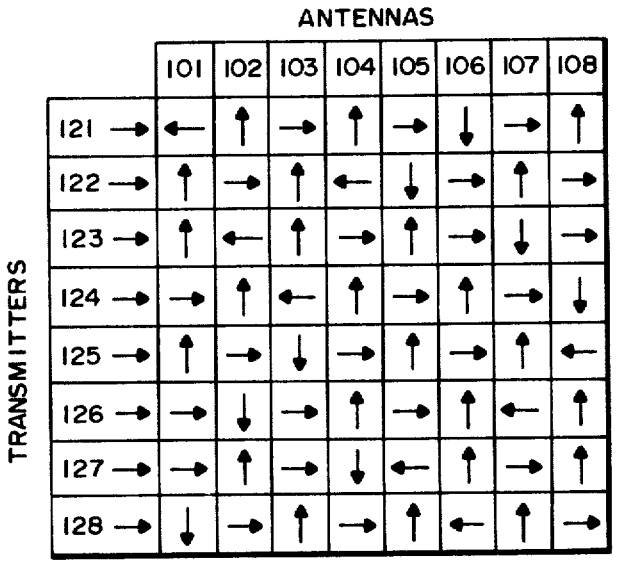
FIG. 10 is a table illustrating various signal phase relationships in the antenna system shown in FIG. 9.

FIG. 10 shows in tabular form the phase of each transmitter signal coupled to each antenna element in the multiple antenna system 120. The same phase notation used in FIG. 5 is also used in FIG. 10. By comparing FIGS. 7 and 10 it can be seen that each of the corner reflector antennas in FIG. 7 will radiate a signal which is 90° out of phase with the signals radiated by each of the immediately adjacent corner reflector antennas. This 90° out of phase relationship between adjacent corner reflector antennas will result in a desired vector addition of the radiated signals.

Figure 11:
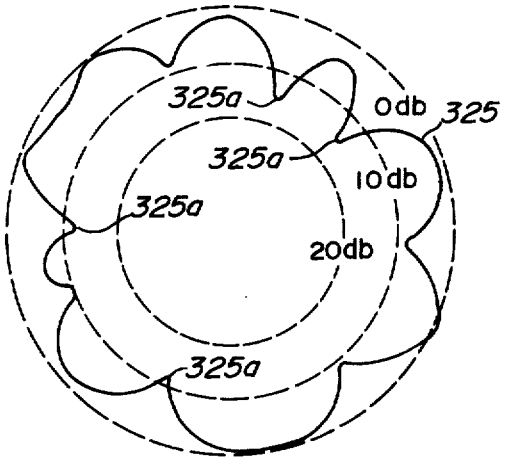
FIG. 11 is a graph of a composite horizontal radiation pattern created by the system in FIG. 9.

FIG. 11 (having the same scale as FIG. 6) illustrates the actual composite radiation pattern 325 which is created by antenna system 120. The pattern 325 has a generally omnidirectional shape with a few relatively deep nulls (325A) as compared to pattern 95 in FIG. 6. Antenna system 120 has therefore provided an improved multiple input transmitter antenna system for simultaneously radiating eight independent signals in a substantially omnidirectional pattern over a single antenna structure. The depth of these deep nulls (325A) can be altered by skewing the antenna elements 101 through 108. These deep nulls are primarily caused by the larger physical size required by the antenna array 100 as compared to the antenna array 20.

In the preferred embodiment of the present invention illustrated in FIG. 3, the phase shifts contributed by each of the connections (such as the connection from terminal 43 to 61, terminal 63 to antenna 21, and transmitter 31 to terminal 41) have been assumed to be zero.

Figure 12:
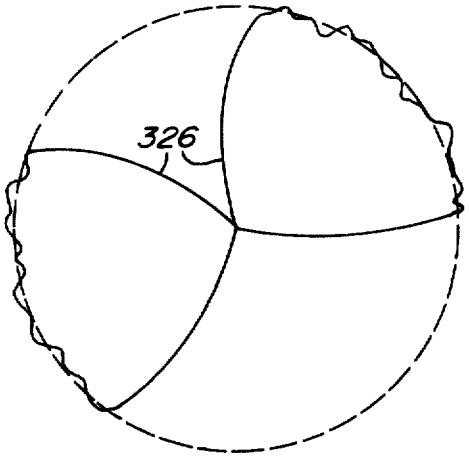
FIG. 12 is a graph illustrating another composite horizontal radiation pattern.

This preferred embodiment will still function properly to produce a substantially omnidirectional pattern as long as the phase shifts contributed by the connections between terminals 43-61, 44-71, 53-62, and 54-72 are equal to each other, in addition to the phase shifts contributed by each of the antenna connections (e.g. terminal 63 to antenna 21) also being equal to each other. Similar statements apply to the preferred embodiment illustrated in FIG. 9, While the primary application of the present invention is the creation of an omnidirectional antenna pattern, FIG. 12 illustrates a hypothetical non-symmetric radiation pattern 326 which could be generated by appropriate placement of radiating elements having appropriate 3 db beam width and phasing relationships. Thus the present invention is not limited to the creation of a omnidirectional radiation pattern. Additionally, the present invention is not limited to the use of the inventive antenna system in conjunction with only transmitters, since receivers may be substituted for any of the transmitters used in the foregoing illustrations. Therefore the inventive antenna system, by reciprocity, can be used equally effectively with both receivers and/or transmitters.

While I have shown and described specific embodiments of this invention, further modifications and improvements will occur to those skilled in the art. All such modifications which retain the basic underlying principles disclosed and claimed herein are within the scope of this invention.

I claim:

1. An improved multiple transmitter antenna system comprising:

a plurality of at least three electrical sources each generating an independent input signal at a different predetermined radio frequency;

a combining network means consisting of broadband components having bandwidths including all of the frequencies generated by said electrical sources, said network means simultaneously coupled to said plurality of sources for simultaneously receiving each of said input signals, maintaining isolation between said input signals, and substantially losslessly producing a number of isolated output signals equal in number to at least the number of said input signals, each one of said output signals being related to each and every one of said input signals; and an antenna array coupled to said combining network, said array comprising a plurality of antenna element means, each of said antenna element means receiving and simultaneously radiating an associated one of said output signals, each of said antenna element means including means for shaping the associated radiated signal in a substantially independent directive associated radiation pattern having a single main unidirectional lobe, each lobe being directed away from all other antenna element means and in a substantially different direction than all other lobes and wherein said independently radiated lobes combine to form a desired composite radiation pattern for each of said plurality of electrical sources, said respective electrical sources having said independent input signals and predetermined frequencies operating within a predetermined bandwidth to produce a composite radiation pattern substantially identical in shape and directivity for each of said plurality of different frequency electrical sources.

2. An improved multiple transmitter antenna system according to claim 1 wherein each of said associated output signals received and radiated by each of said antenna element means is 90° out of phase with the signals received by the antenna element means immediately adjacent.

3. An improved multiple transmitter antenna system according to claim 2 wherein all of said element means are substantially circularly positioned around a center axis and each of said element means is positioned such that its main lobe is directed away from said center point.

4. An improved multiple transmitter antenna system according to claim 3 wherein each main unidirectional lobe produced by each antenna element means has a half power bandwidth of no more than 90 degrees, and wherein said composite radiation pattern has a half power bandwidth substantially greater than each main unidirectional lobe.

5. An improved multiple transmitter antenna system according to claim 1 wherein said combining network means comprises a plurality of hybrid networks each having first, second, third and fourth ports, each of said hybrid networks coupling a signal from either of said first and second ports to said third and fourth ports, the signal coupled to said third port being substantially equal in magnitude to and having a fixed phase difference from the signal coupled to said fourth port.

6. An improved multiple transmitter antenna system according to claim 5 wherein said fixed phase difference is 90°.

7. An improved multiple transmitter antenna system according to claim 6 wherein said combining network means includes a first circuit comprising first, second, third, and fourth hybrid networks of said plurality of hybrid networks, the third and fourth ports of said first hybrid network being coupled to the first ports of said third and fourth hybrid networks, respectively, and the third and fourth ports of said second hybrid being coupled to the second ports of said third and fourth hybrid networks respectively.

8. An improved multiple transmitter antenna system according to claim 7 wherein each of said third and fourth ports of said third and fourth hybrid networks is coupled to an associated one of said antenna element means.

9. An improved multiple transmitter antenna system according to claim 7 which includes a second circuit comprising a fifth, sixth, seventh and eighth one of said plurality of hybrid networks connected identically as said first, second, third and fourth hybrid networks, respectively.

10. An improved multiple transmitter antenna system according to claim 9 which includes a ninth one of said hybrid networks having its first and second ports coupled to the third ports of said third and seventh hybrid networks respectively, a tenth one of said hybrid networks having its first and second ports coupled to the fourth port of said third and seventh hybrid networks respectively, an eleventh one of said hybrid networks having its first and second ports coupled to the third ports of said fourth and eighth hybrid networks respectively, and a twelfth one of said hybrid networks having its first and second ports coupled to the fourth ports of said fourth and eighth hybrid networks, respectively.

11. An improved multiple input antenna system, comprising:

a plurality of at least three independent, isolated electrical devices each adaptable for processing radio frequency signals at different radio frequencies;

a plurality of isolated antenna elements equal in number to at least the number of said electrical devices, each of said elements disposed in a predetermined manner and including means for independently generating and shaping an associated directional radiation pattern directed away from all other antenna elements, wherein each of said antenna elements comprises a corner reflector antenna; and a substantially lossless combining network means consisting of broadband components having bandwidths including all of said radio frequencies, said network means coupled to each of said antenna elements and each of said electrical devices for simultaneously coupling each of said devices to each and every one of said antenna elements while maintaining broadband isolation between all of said antenna elements and all of said electrical devices;

said network means creating a predetermined phase difference between each of said directive radiation patterns such that said patterns combine to form a desired composite radiation pattern for each of said plurality of independent devices, said respective electrical devices processing signals at said different frequencies operating within a predetermined bandwidth to produce a composite radiation pattern substantially identical in shape and directivity for each of said plurality of different frequency electrical devices.

12. An improved multiple input antenna system, comprising:

a plurality of at least three independent, isolated electrical devices each adaptable for processing radio frequency signals at different radio frequencies;

a plurality of isolated antenna elements equal in number to at least the number of said electrical devices, each of said elements disposed in a predetermined manner and including means for independently generating and shaping an associated directional radiation pattern directed away from all other antenna elements; and a substantially lossless combining network means consisting of broadband components having bandwidths including all of said radio frequencies, said network means coupled to each of said antenna elements and each of said electrical devices for simultaneously coupling each of said devices to each and every one of said antenna elements while maintaining broadband isolation between all of said antenna elements and all of said electrical devices;

said network means creating a predetermined phase difference between each of said directive radiation patterns such that said patterns combine to form a desired composite radiation pattern for each of said plurality of independent devices, said respective electrical devices for processing signals at said different frequencies operating within a predetermined bandwidth to produce a composite radiation pattern substantially identical in shape and directivity for each of said plurality of different frequency electrical devices.

13. An improved multiple input antenna system according to claim 12 wherein said combining network means comprises a plurality of hybrid networks.

14. An improved multiple input antenna system according to claim 13 wherein said phase differences is 90°.

15. An improved multiple input antenna system comprising:

a plurality of at least three independent, isolated electrical devices for processing radio frequency signals having different frequencies;

a plurality of at least four isolated antenna elements each of said elements disposed in a predetermined manner and including means for independently generating and shaping an associated directive radiation pattern directed away from all other antenna elements; and a combining network means coupled to each of said antenna elements and each of said electrical devices for simultaneously coupling each of said devices to each and every one of said antenna elements while maintaining isolation between all of said antenna elements and all of said electrical devices;

said network means creating a predetermined phase difference between each of said directive radiation patterns such that said patterns combine to form a desired, composite, radiation pattern for each of said plurality of independent devices;

said network means including a first circuit comprising first, second, third, and fourth hybrid networks each having first, second, third and fourth ports, each of said hybrid networks capable of coupling a signal from either of said first and second ports to said third and fourth ports, the signal coupled to said third port being substantially equal in magnitude to and having a fixed phase difference from the signal coupled to said fourth port, the third and fourth ports of said first hybrid network being coupled to the first ports of said third and fourth hybrid networks, respectively, and the third and fourth ports of said second hybrid being coupled to the second ports of said third and fourth hybrid networks respectively, said respective electrical devices for processing signals at said different frequencies operating within a predetermined bandwidth to produce a composite radiation pattern substantially identical in shape and directivity for each of said plurality of different frequency electrical devices.

16. An improved multiple input antenna system according to claim 15 wherein each of at least three of said first and second ports of said first and second hybrid networks is coupled to an associated one of said electrical devices.

17. An improved multiple input antenna system according to claim 16 wherein each of said third and fourth ports of said third and fourth hybrid networks is coupled to an associated one of said antenna element means.

18. An improved multiple input antenna system according to claim 17 wherein said composite radiation pattern is substantially omnidirectional.

19. An improved multiple input antenna system according to claim 15 wherein each of said associated directive radiation patterns produced by each of said antenna elements has a half power beam width of no more than 90°, and wherein said desired composite radiation pattern has a half power beam width substantially greater than each associated antenna element radiation pattern.

20. An improved multiple transmitter antenna system comprising:

a plurality of at least three electrical sources each generating an independent input signal at a different predetermined radio frequency;

a combining network means consisting of broadband components having bandwidths including all of the frequencies generated by said electrical sources, said network means simultaneously coupled to said plurality of sources for simultaneously receiving each of said input signals, maintaining isolation between said input signals, and substantially losslessly producing a number of isolated output signals equal in number to at least the number of said input signals, each one of said output signals being related to each and every one of said input signals; and an antenna array coupled to said combining network means, said array comprising a plurality of antenna element means, each of said antenna element means receiving and simultaneously radiating an associated one of said output signals, each of said antenna element means including means for shaping the associated radiated signal in a substantially independent directive associated radiation pattern having a single main unidirectional lobe, each lobe being directed away from all other antenna element means and in a substantially different direction than all other lobes and wherein said independently radiated lobes combine to form a desired composite radiation pattern for each of said plurality of electrical sources, wherein each of said antenna element means comprises a corner reflector antenna, said respective electrical sources having said independent input signals and predetermined frequencies operating within a predetermined bandwidth to produce a composite radiation pattern substantially identical in shape and directivity for each of said plurality of different frequency electrical sources.

21. An improved multiple transmitter antenna system according to claim 20 wherein each of said associated output signals received and radiated by each of said antenna element means is 90° out of phase with the signals received by the antenna element means immediately adjacent.

22. An improved multiple transmitter antenna system according to claim 20 wherein said combining network means comprises a plurality of hybrid networks each having first, second, third and fourth ports, each of said hybrid networks coupling a signal from either of said first and second ports to said third and fourth ports, the signal coupled to said third port being substantially equal in magnitude to and having a fixed phase difference from the signal coupled to said fourth port.

23. An improved multiple transmitter antenna system according to claim 22 wherein said fixed phase difference is 90°.

24. An improved multiple transmitter antenna system according to claim 23 wherein said combining network means includes a first circuit comprising first, second, third, and fourth hybrid networks of said plurality of hybrid networks, the third and fourth of said first hybrid network being coupled to the first ports of said third and fourth hybrid networks, respectively, and the third and fourth ports of said second hybrid being coupled to the second ports of said third and fourth hybrid networks respectively.

25. An improved multiple transmitter antenna system according to claim 24 wherein each of said third and fourth ports of said third and fourth hybrid networks is coupled to an associated one of said antenna element means.

26. An improved multiple transmitter antenna system according to claim 25 wherein each of said first and second ports of said first and second hybrid networks is coupled to an associated one of said plurality of electrical sources.

27. An improved multiple transmitter antenna system according to claim 26 wherein said corner reflector antennas are circularly disposed about a center point and arranged such that the signal received by each of said reflector antenna is 90° out of phase with the signals received by the reflector antennas that are immediately adjacent.

28. An improved multiple transmitter antenna system according to claim 27 wherein said corner reflector is constructed such that it radiates a single main unidirectional radiation lobe having a half power beam width of 45°.

29. An improved multiple transmitter antenna system according to claim 24 which includes a second circuit comprising a fifth, sixth, seventh and eighth one of said plurality of hybrid networks connected identically as said first, second, third and fourth hybrid networks, respectively.

30. An improved multiple transmitter antenna system according to claim 29 which includes a ninth one of said hybrid networks having its first and second ports coupled to the third ports of said third and seventh hybrid networks respectively, a tenth one of said hybrid networks having its first and second ports coupled to the fourth port of said third and seventh hybrid networks respectively, an eleventh one of said hybrid networks having its first and second ports coupled to the third ports of said fourth and eighth hybrid networks respectively, and a twelfth one of said hybrid networks having its first and second ports coupled to the fourth ports of said fourth and eighth hybrid networks, respectively.

31. An improved multiple transmitter antenna system according to claim 30 wherein each of the third and fourth ports of said ninth, tenth, eleventh and twelfth hybrid networks is coupled to an associated one of said antenna element means.

32. An improved multiple transmitter system according to claim 21 wherein said desired composite radiation pattern is substantially omnidirectional for each of said plurality of electrical sources, and wherein each main unidirectional lobe produced by an associated one of said antenna element means has a half power beam width of no more than 90°.

33. An improved multiple transmitter antenna system according to claim 21 wherein all of said element means are substantially circularly positioned around a center axis and each of said element means is positioned such that its main lobe is directed away from said center axis.

34. An improved multiple transmitter antenna system according to claim 33 wherein each of said corner reflectors is positioned such that its main lobe is radially directed away from said center axis.

35. An improved multiple input antenna system comprising:

a plurality of at least three independent, isolated electrical devices for processing radio frequency signals having different frequencies;

a plurality of at least four isolated antenna elements each of said elements disposed in a predetermined manner and including means for independently generating and shaping an associated directive radiation pattern directed away from all other antenna elements, wherein each of said antenna elements comprises a corner reflector antenna; and a combining network means coupled to each of said antenna elements and each of said electrical devices for simultaneously coupling each of said devices to each and every one of said antenna elements while maintaining isolation between all of said antenna elements and all of said electrical devices;

said network means creating a predetermined phase difference between each of said directive radiation patterns such that said patterns combine to form a desired, composite, radiation pattern for each of said plurality of independent devices;

said network means including a first circuit comprising first, second, third, and fourth hybrid networks each having first, second, third and fourth ports, each of said hybrid networks capable of coupling a signal from either of said first and second ports to said third and fourth ports, the signal coupled to said third port being substantially equal in magnitude to and having a fixed phase difference from the signal coupled to said fourth port, the third and fourth ports of said first hybrid network being coupled to the first ports of said third and fourth hybrid networks, respectively, and the third and fourth ports of said second hybrid network being coupled to the second ports of said third and fourth hybrid networks respectively, said respective electrical devices processing signals at said different frequencies operating within a predetermined bandwidth to produce a composite radiation pattern substantially identical in shape and directivity for each of said plurality of different frequency electrical devices.

36. An improved multiple input antenna system according to claim 35 wherein each of said directive radiation patterns produced by each of said antenna elements has a half power beam width of no more than 90°, and wherein said desired composite radiation pattern has a half power beam width substantially greater than each associated antenna element directive radiation pattern.

37. An improved multiple input antenna system according to claim 35 wherein each of at least three of said first and second ports of said first and second hybrid networks is coupled to an associated one of said electrical devices.

38. An improved multiple input antenna system according to claim 37 wherein each of said third and fourth ports of said third and fourth hybrid networks is coupled to an associated one of said antenna elements.

39. An improved multiple input antenna system according to claim 38 wherein said composite radiation pattern is substantially omnidirectional.

40. An improved multiple input antenna system according to claim 39 wherein said predetermined phase difference is 90°.

41. An improved multiple transmitter antenna system according to claim 37 which includes an associated one of said plurality of electrical sources coupled to each of the first and second ports of said first, second, fifth and sixth hybrid networks.

42. An improved multiple transmitter antenna system according to claim 41 wherein each of said hybrid networks has circuitry to couple a signal from its first to third port with a 180° phase shift and to couple a signal from its second to fourth port with a 180° phase shift.

43. An improved multiple transmitter antenna system according to claim 42 wherein said corner reflector antennas are circularly disposed about a center point and arranged such that the signal received by each of said reflector antenna is 90° out of phase with the signals received by the reflector antennas that are immediately adjacent.

44. An improved multiple transmitter antenna system according to claim 43 wherin each corner reflector is constructed such that it radiates a single main unidirectional radiation lobe having a half power beam width of 45°.

* * * * *

UNITED STATES PATENT AND TRADEMARK OFFICE

CERTIFICATE OF CORRECTION

PATENT NO. : 4,213,132

DATED : 7/15/80

INVENTOR(S) : Allen Loy Davidson

It is certified that error appears in the above—identified patent and that said Letters Patent is hereby corrected as shown below:

On The Title Page, Item (75) should read

-- Allen Loy Davidson --.

In column 1, line 7 of the patent, prior to the word "application", please insert --continuation-in-part--.

In the second line of claim 41, please delete the numeral "37" and insert --31--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*